US005792236A

United States Patent [19]

Taylor et al.

[11] Patent Number: 5,792,236

[45] Date of Patent: *Aug. 11, 1998

[54] NON-TOXIC LIQUID METAL COMPOSITION FOR USE AS A MERCURY SUBSTITUTE

[75] Inventors: Larry T. Taylor; James Rancourt, both of Blacksburg, Va.

[73] Assignee: Virginia Tech Intellectual Properties, Inc., Blacksburg, Va.

[ * ] Notice: The term of this patent shall not extend beyond the expiration date of Pat. No. 5,478,978.

[21] Appl. No.: 560,634

[22] Filed: Nov. 20, 1995

Related U.S. Application Data

[63] Continuation-in-part of Ser. No. 199,875, Feb. 22, 1994, Pat. No. 5,478,978, which is a continuation-in-part of Ser. No. 22,118, Feb. 25, 1993, Pat. No. 5,391,846, which is a continuation-in-part of Ser. No. 320,902, Oct. 11, 1994, Pat. No. 5,508,003.

[51] Int. Cl.[6] ..... C22C 28/00

[52] U.S. Cl. ..... 75/715; 75/688; 75/715; 141/64; 200/233; 423/111; 423/115; 423/127; 423/131

[58] Field of Search ..... 75/688, 715; 141/64; 200/233; 423/111, 115, 127, 131

[56] References Cited

U.S. PATENT DOCUMENTS

| | | | |
|---|---|---|---|
| B 333,928 | 1/1975 | Stevens | 423/129 |
| 3,369,094 | 2/1968 | Langberg et al. | 200/140 |
| 3,462,573 | 8/1969 | Rabinowitz et al. | 200/152 |
| 4,865,823 | 9/1989 | Minagawa et al. | 423/112 |
| 5,021,618 | 6/1991 | Ubukata et al. | 200/61.47 |
| 5,458,669 | 10/1995 | Maeda et al. | 75/10.67 |
| 5,478,978 | 12/1995 | Taylor et al. | 200/233 |

FOREIGN PATENT DOCUMENTS

| | | | |
|---|---|---|---|
| 57-233016 | 1/1987 | Japan | C22C 28/00 |

*Primary Examiner*—David A. Simmons
*Assistant Examiner*—M. Alexandra Elve
*Attorney, Agent, or Firm*—Whitham, Curtis & Whitham

[57] ABSTRACT

Liquid gallium or gallium alloy is utilized as a mercury substitute for a variety of applications. The liquid gallium or gallium alloy is either free of metal oxides or has only very low quantities of metal oxides.

16 Claims, 1 Drawing Sheet

NON-TOXIC LIQUID METAL COMPOSITION FOR USE AS A MERCURY SUBSTITUTE

CROSS-REFERENCE TO RELATED APPLICATIONS

This patent application is a continuation-in-part (CIP) application of the patent application having U.S. Ser. No. 08/199,875 filed Feb. 22, 1994 now U.S. Pat. No. 5,478,978, which was a continuation-in-part of U.S. Ser. No. 08/022,118 filed Feb. 25, 1993 now U.S. Pat. No. 5,391,846, the complete contents of which are herein incorporated by reference. This patent application is also a continuation-in-part (CIP) application of the patent application having U.S. Ser. No. 08/320,902 filed Oct. 11, 1994 now U.S. Pat. No. 5,508,003, the complete contents of which are herein incorporated by reference.

DESCRIPTION

BACKGROUND OF THE INVENTION

1. Field of the Invention

The subject invention is generally directed to non-toxic substitutes for mercury for use in a variety of applications. More particularly, the invention is directed to certain gallium alloys that have desirable properties for use in electrical switches, temperature sensors and thermometers, pressure sensors or pressure activated switches, pumps and filters, liquid mirror telescopes, fluid unions, slip rings, medical devices such as bougies and sphygmomanometers, dental amalgam, and in a wide variety of other devices and materials.

2. Description of the Prior Art

Mercury is used extensively in switches and sensors. In a common switch application, liquid mercury is positioned inside a fluid tight housing into which a pair of spaced apart electrodes extend. Depending on the physical orientation of the housing, the liquid mercury can provide a conductive pathway between the electrodes or the positioned such that there is an open circuit between the electrodes. An important physical attribute of mercury is that it remains fluid throughout a wide temperature range. This attribute allows mercury to be used in many different environments and in environments with constantly changing temperature parameters. Another important physical attribute of mercury is that it has significant surface tension and does not wet glass, metal or polymer surfaces. However, mercury is toxic to humans and animals. As such, finding non-toxic alternatives to mercury that have comparable performance characteristics would be beneficial.

Two examples of prior art references which discuss gallium alloys as non-toxic substitutes for mercury in switch applications include U.S. Pat. No. 3,462,573 to Rabinowitz et al. and Japanese Patent Application Sho 57-233016 to Inage et al. Both documents identify gallium/indium/tin alloys as being potentially useful. Gallium has the advantages of remaining in the liquid phase throughout a wide temperature range and has a very low vapor pressure at atmospheric pressure. Combining other metals with gallium can depress the freezing point for the composition below that of gallium alone (29.7°). Rabinowitz et al. states that a 62.5% gallium, 21.5% indium, and 16% tin composition forms a eutectic that has a freezing point of 10° C. The Japanese Patent Application to Inage asserts that adding 1–3.5% silver to a gallium/indium/tin eutectic can lower the freezing point closer to 0° C.

It would be advantageous to identify an alloy which has a freezing point below 0° C. in order for the eutectic to be used in the largest and broadest possible number of applications.

Neither Rabinowitz et al. nor Inage et al. discuss "wetting" problems encountered with gallium alloys. Rather, they suggest that the gallium alloy can be used in an envelope made of a material that is not wetted by gallium. As will be discussed below, gallium oxide, which is readily formed in gallium alloys, has the disadvantage of wetting many different surfaces.

SUMMARY OF THE INVENTION

It is an object of this invention to provide a gallium alloy that has performance properties at least as good or better than mercury in a wide variety of applications.

It is also an object of this invention to provide a metallic material for use as a mercury substitute containing gallium, indium, zinc, and copper, which has a solidification temperature below 0° C.

It is another object of this invention to provide a superior method for producing devices and materials such as temperature sensors and thermometers, pressure sensors or pressure activated switches, pumps and filters, liquid mirror telescopes, fluid unions, slip rings, bougies, sphygmomanometers, dental amalgam, and a wide variety of other devices which utilize gallium or gallium alloys.

It is yet another object of this invention to provide an apparatus which will allow those devices which employ gallium and gallium alloys to be prepared without oxidation of the gallium during and after the fabrication process.

According to the invention, processes and apparatuses have been developed which enable production of mercury substitutes using gallium and gallium alloys without oxidation of the metal occurring during or after fabrication. Gallium alloys have many of the same attributes as mercury, similar flow characteristics, and the like. Therefore, the gallium based metallic materials can be used as a substitute for mercury in a wide variety of applications including use in an electrical switch or sensor, use in temperature sensors and thermometers, use in pressure sensors or pressure activated switches, use in pumps and filters, use in liquid mirror telescopes, use in fluid unions, use in slip rings, use in medical devices such as bougies and sphygmomanometers, use as a dental amalgam, and in a wide variety of other uses. It has been discovered that gallium alloys are extremely prone to oxidation and that even slight oxidation of the metal will be detrimental to the performance of the mercury substitute. In addition, it has been discovered that incorporating small amounts of bismuth within specified ranges in a gallium alloy effectively suppresses the freezing point of the gallium alloy to near 0° C.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE PREFERRED EMBODIMENTS OF THE INVENTION

Figure 1:
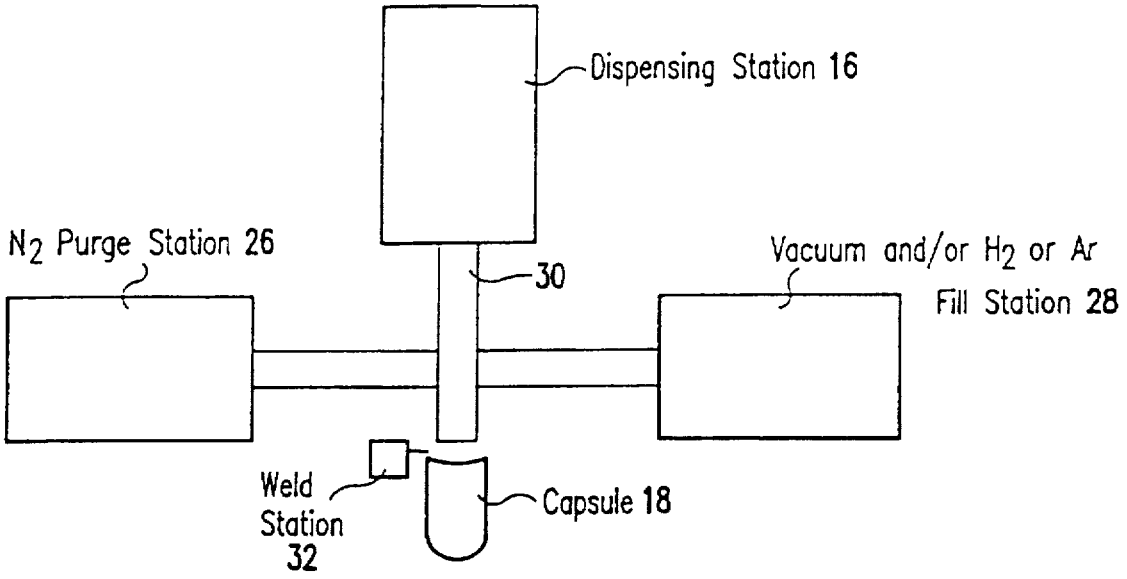
FIG. 1 is a schematic diagram showing an apparatus for filling a device housing with gallium or a gallium alloy.

This invention is particularly related to gallium and gallium alloys as a non-toxic substitute for mercury. It should be understood that a wide variety of metals can be combined with gallium to practice the present invention (e.g., silver, gold, lead, thallium, cesium, palladium, platinum, sodium, selenium, lithium, potassium, cadmium, bismuth, indium, tin, antimony, etc.).

Gallium/indium/tin alloys have proven to have particular potential as a mercury substitute. Gallium/indium/tin alloys are commercially available from Johnson Matthey at 99.99% purity (62.5% Ga, 21.5% In, and 16% Sn). Typically, the primary component of the gallium/indium/tin alloy is gallium and it constitutes approximately 60–75% of the composition. Indium is generally incorporated in the composition at level of 15–30% and tin is incorporated at a level of 1–16%. A practical problem with gallium, indium, tin and other potential constituents of low melting alloys is the propensity of the constituents to form surface oxide layers. These materials must be kept under a nonoxidizing atmosphere at all times to obtain optimum electrical and physical properties from the alloy. Further, if the surfaces of the constituents have oxidized the oxide results in the need for more vigorous alloy preparation methodologies.

A problem with the gallium/indium/tin alloy is that it has a freezing point of approximately 11° C. While this freezing point is lower than gallium alone (29° C.), many mercury applications require performance at or below the freezing point of water (0° C.). Adding small quantities (less than 5%) of other non-toxic elements such as lithium, sodium, rubidium, silver, antimony, gold, platinum, cesium and bismuth to the gallium/indium/tin alloy provides a mechanism for depressing the freezing point of the alloy. However, experiments have demonstrated that the quantity of the additive needs to be controlled to achieve freezing point depression.

Table 1 lists the compositions of a plurality of alloys that have been prepared and their physical state at 4° C.

TABLE 1

| % Ga | % In | % Sn | % Ag | % Bi | Physical state |
|---|---|---|---|---|---|
| 62.5 | 21.5 | 16 | | | solid |
| 61.99 | 25 | 13 | | | solid |
| 67.98 | 20.01 | 10.5 | 1.51 | | liquid |
| 59.52 | 20.48 | 15.24 | 4.76 | | solid |
| 67.99 | 20 | 10.5 | | 1.51 | solid |
| 68.10 | 19.9 | 10.5 | 1.1 | 0.4 | liquid |
| 67.98 | 20.02 | 10.5 | 0.75 | 0.76 | liquid |
| 67.98 | 20.01 | 10.5 | 0.38 | 1.13 | solid |

The freezing point data for the compositions shown in Table 1 were determined using differential scanning calorimetry. Table 1 demonstrates that the Ga/In/Sn/Ag alloys described in the Inage et al. Japanese Patent Application do not necessarily depress the freezing point below 4° C. Rather, it was observed that most of these compositions began to solidify at 5° C. and were completely solid at 4° C. Table 1 also shows that gallium alloys that include a small amount of bismuth remain liquid at 4° C.

One particular formulation (68% Ga, 20% Sn, 10.5% In, 0.75% Bi, 0.75% Ag) was found to have a freezing point near −4° C. This determination was made in a salt/ice water bath. In principle, the reduction in freezing point of the water bath induced by the addition of impurities (salt) is the operating principle for the preparation of low melting alloys. That is, the intentional addition of impurities to a pure compound or to a mixture of compounds reduces the melting point of the host material. The general direction of the preparation of novel alloys involves the addition of minor amounts of additional ingredients; less than approximately 10% on a weight basis. Also, the crystal structure and atomic size of the additional ingredients are preferably different from these properties for the host matrix. This helps to insure that crystallization of the host alloy is inhibited.

An additional property expected for the low melting alloys is a lower bulk electrical resistivity than mercury metal. This is based on tabulated data that shows that all of the major ingredients of the claimed low melting alloys are approximately twenty times more conductive than mercury metal. Finally, the density of the low melting alloys is approximately one half the density of mercury. This provides for a potential weight savings in weight-sensitive applications.

The preferred alloy for use as a mercury substitute in the present invention contains gallium, indium, zinc, and copper. Metallic materials or alloys which contain these metals and have solidification temperatures below 0° C. have been prepared. These metallic materials have the following attributes:

electrical conductivity (can conduct both AC and DC current); solidification temperature near −10° C.; very high boiling point; very low vapor pressure at room temperature; and similar flow characteristics to mercury. These metallic materials were prepared by weighing out each component individually, and adding the component to a single Erlenmeyer flask. Gallium was first weighed into the flask in the amount desired. The precise amount of each additional component was determined according to the following equations:

$$100 \times \frac{\text{Wt. of Ga measured}}{\text{\% Ga desired in material}} = \text{Total Wt. of Material Desired}$$

$$\frac{(\text{\% Additional Element})\,(\text{Total Wt. Desired})}{100} = \text{Wt. of Element Measured}$$

After introduction of all components into the flask, aqueous base was added to the flask. Good results were achieved using 50 mL of 30% NaOH; however, it should be understood that other aqueous bases could be used in the practice of this invention such as KOH, $NH_4OH$, and the like. The primary function of the aqueous base is to clean the metals and enable the prue metals to interact. The liquid base also provides an inert environment for the metals. Gallium and indium dissolve in aqueous base, but zinc and copper do not. It has been observed that when the combination of metals and aqueous base are stirred in a loosely stoppered flask at room temperature (15°–35° C.) for short periods of time (e.g., 5–30 minutes) the contents of the flask become liquid in character and have both an aqueous phase and a metallic phase.

The metallic phase includes the "metallic material" or "alloy" of the present invention, and it is obtained by drawing the aqueous phase off of the metallic layer, transferring the metallic component to a test tube, and subjecting the metallic component to a heat treatment. Preferably, the metallic component is heated under a nitrogen atmosphere, or similar inert environment, so that the metallic material does not become oxidized.

The heating schedule employed was as follows: 8° C./min to 100° C.; hold at 100° C. for 10 minutes, increase temperature at 8° C./min to 450° C.; hold for 4 hours at 450° C.; then cool to room temperature at approximately 3° C. The heat treatment can likely be varied in the practice of this invention. For example, higher temperatures for shorter periods of time, or lower temperatures for longer periods of time may be used to make the quaternary metallic material of this invention. All that is required is for the heat treatment to be sufficient for forming a metallic material or alloy from the combined metallic components. After cooling to room temperature, aqueous base is preferably added to the metallic material to remove any black oxide film that might have formed during handling of the material.

The heat treatment yields both a liquid product and a solid product. The mass ratio of the product depends on the composition of the formulating mixture. The amount of each product can be ascertained by first drawing off the metallic liquid into a previously tared vial followed by weighing. The solid residue is then isolated, dried, and independently weighed. For example purposes, Table 2 provides the conditions used for synthesis of the mercury replacement material according to this invention along with the approximate weights for the components.

TABLE 2

| Typical Conditions for Synthesis of Mercury Replacement Material | |
|---|---|
| Weight of Ga | 38 g |
| Weight of In | 11 g |
| Weight of Zn | 0.5 g |
| Weight of Cu | 1.0 g |
| 50 mL of 30% Aqueous base | |
| Pre-purified Nitrogen gas | |
| Heat at 300–450° C. | |
| Liquid product | 45 g |
| Solid residue | 5 g |

Table 3 presents the theoretical weight percent values for a metallic material produced with the components presented in Table 2.

TABLE 3

| Theoretical Values | |
|---|---|
| Component | Percentage |
| Ga | 75.1 |
| In | 21.81 |
| Zn | 1.00 |
| Cu | 2.00 |

Table 4 presents the elemental analysis from a duplicate study of five liquid product (A–E) prepared according to the above technique with the composition presented in Table 2, as well as the elemental analysis of the residual solids (AA) isolated from liquid product A.

TABLE 4

| Elemental Analysis | | | | | | |
|---|---|---|---|---|---|---|
| Component | A | AA | B | C | D | E |
| Ga | 76.8 | 63.6 | 77.5 | 73.6 | 76.8 | 76.7 |
| In | 22.5 | 9.69 | 21.1 | 25.3 | 22.3 | 22.5 |
| Zn | 0.98 | 1.12 | 0.98 | 0.95 | 0.98 | 0.96 |
| Cu | 0.01 | 20.3 | 0.0003 | 0.002 | 0.24 | 0.15 |
| Total | 100.29 | 94.705 | 99.0 | 99.752 | 100.0 | 100.205 |

Table 5 presents the solidification temperatures for the five liquid products identified in Table 4.

TABLE 5

| Solidification Temperature Measurements | | | | | |
|---|---|---|---|---|---|
| | A | B | C | D | E |
| Solidification Temperature (°C.) | −10 | −9 | −10 | −10 | −11 |

Tables 2–5 demonstrate that the quaternary metallic materials, which include gallium, indium, zinc and copper in specific weight percent combinations, can be prepared in a manner which produces a product having a solidification temperature below 0° C. The preferred metallic materials of this invention will have a solidification temperature ranging between −1° C. and −15° C. Table 4 demonstrates that only a very small percentage of copper starting material becomes part of the metallic material, and the remainder is separated as part of the residual solids. However, tests have demonstrated that including the copper in the quaternary metallic material is important to achieve optimum solidification temperature suppression. Tables 3 and 4 also show that the weight percentage of zinc in the metallic material is close to the theoretical value that the weight percentage of gallium and zinc are higher than the theoretical value. This is due to much of the copper component not becoming part of the metallic material.

The weight percentages of the components in a Ga-In-Zn-Cu metallic material according to this invention may vary from those achieved with the products A–E in Table 4, yet still result in a metallic material with a solidification temperature below 0° C. Varying the weight percentages of the four components in the final metallic material is achieved by adjusting the relative weights of the individual components when they are combined in the aqueous base. Preferably, the weight percentage of each component in the Ga-In-Zn-Cu metallic material falls within the ranges specified in Table 6.

TABLE 6

| Weight Percentage Range | |
|---|---|
| Ga | 70–80 |
| In | 20–29 |
| Zn | 0.05–5 |
| Cu | 0.0001–1 |

Most preferably, the weight percentage of each component in the Ga-In-Zn-Cu metallic material falls within the ranges specified in Table 7.

TABLE 7

| Preferred Weight Percentage Range | |
|---|---|
| Ga | 72–78 |
| In | 20–26 |
| Zn | 0.1–1 |
| Cu | 0.0001–.3 |

Gallium alloys have many of the same attributes as mercury, such as high vaporization temperature (>2000° C.), similar flow characteristics, and the like. Therefore, the gallium based metallic materials can be used as a substitute for mercury in a wide variety of applications including use in temperature sensors and thermometers, use in pressure sensors or pressure activated switches, use in pumps and filters, use in liquid mirror telescopes, use in fluid unions, use in slip rings, use as a dental amalgam, and in a wide variety of other uses.

Experiments have shown that gallium and gallium alloys such as those described above are readily oxidized when exposed to ambient air. Oxidation changes the color of the alloy from highly reflective to a dull grey. The dull grey color may be considered aesthetically objectionable by consumers that are used to handling mercury. More importantly, oxidation drastically changes the performance characteristics of the alloy in the switch. Specifically, the oxidized alloy may have a higher electrical resistance. Initial experiments demonstrated that a number of different materials would be wetted by oxidized gallium alloys including glass and high density polyethylene. However, subsequent experiments demonstrated that when oxides of the metal components in the gallium alloy were removed and formation of oxides during and after switch fabrication were prevented, the gallium alloy would not wet the switch housing materials. Thus, proper handling of the gallium alloy can make the material useful as a conducting fluid in an electrical switch with no treatment of the switch housing. This observation has not heretofore been observed by any other group. In fact, substantial wetting problems with gallium and gallium alloys may explain why these materials have not been commercially used as a substitute for mercury.

FIG. 1 shows a schematic drawing of an apparatus designed to prepare sensors (thermometers, etc.) and other devices that will employ gallium and gallium alloys. Gallium and other metals will be dispensed at dispensing station 16. The metals can be combined together at the dispensing station 16 or dispensed separately from individual containers. The metals may be in solid or liquid form at the dispensing station 16. If in solid form, the gallium alloy will be formed by heating the metals after they have been deposited in device capsule 18. Likewise, if separate dispensers are used for each metal (tin, indium, bismuth, etc.), and the metals are in the liquid state, the gallium alloy will be prepared after the metals are deposited in the capsule 18 by heat treatment. Heat can be applied to the metal within the capsule using conventional heating techniques, irradiation techniques, or by other means. Alternatively, it has been found quite practical to create the alloy prior to its being dispensed from the dispensing station 16 into the capsule 18.

In addition, despite the fact that the melting point of indium is 157° C. and the melting point of tin is 232° C., we have formed low melting alloys from these elements with gallium at low temperature. Specifically, if each of the ingredients is first treated to remove the metal oxide surface layer (using base (NaOH), for example), then alloy can be prepared at just above room temperature (near 30° C., the melting point of gallium) in a short period of time. We view the gallium as essentially a "solvent" for the other ingredients. Forming the gallium alloys at a temperature just above room temperature is preferable, since heat treatment can result in some waste of the material.

The capsule 18 can be made from a wide variety of materials including polymers, glasses, ceramics and metals. The inside of the capsule 18 can be pre-filled with an inert atmosphere, evacuated by vacuum pressure, and/or can be pre-treated with an anti-oxidant, an acid or base wash, or with a polymer coating. Fluoroalkyl acrylate polymer coatings available from 3M have been found to be less likely to wet than some untreated materials. Silicone coatings also work well.

However, the chief requirement to prevent wetting of the capsule 18 is to prevent oxidation of the gallium alloy itself. Oxidation has a significant impact on switch performance. The metals dispensed at dispensing station 16 should be pretreated to remove oxides prior to the metals being deposited in the capsule. Oxide removal can be accomplished by a number of different procedures. For example, each of the metals in the gallium alloy can individually be exposed to an acid or base wash, or be exposed to some other chemical or physical or mechanical procedure for removing oxides. Alternatively, the gallium alloy can be created first and then be exposed to chemical, mechanical or physical processes that remove oxides.

Experiments have been conducted with both HCl and NaOH as wash solutions for the metals in the gallium alloy. The metals are washed simply by mixing the metals together with HCl or NaOH. Although HCl will remove oxides from gallium, indium and tin, it has been found that HCl has the disadvantage of reacting with the metals to form metal chlorides. The presence of metal chlorides in the gallium alloy is detrimental to switch or sensor performance. It has been observed that switches prepared with gallium/indium/tin where each ingredient was pretreated with HCl, have resulted in switches where the switch housing was coated with a hazy white material. Conversely, when the metals in the gallium alloy were treated with NaOH, reaction products of the metals with the NaOH were not created. It is expected that a wide variety of different acids, bases, and other compounds can be used to remove the oxides from the metals in the gallium alloy, and the use of NaOH and HCl should be considered merely exemplary.

An intentional, low level of metal oxide on the surface of the low melting alloy may be beneficial to switch performance in some applications. In such an application, the tiny metal oxide particles would serve to reduce the amount of liquid-solid contact between the alloy and the housing. This can render the alloy more responsive than a conventional alloy. Aluminum chloride, for example, has been used in specialty mercury switches. However, in all cases, the level of metal oxide in the gallium alloy should be kept extremely low to prevent surface wetting problems and preferably should not exceed 1% by weight of the alloy and is most preferably less than 0.1% by weight of the alloy.

Figure 2:
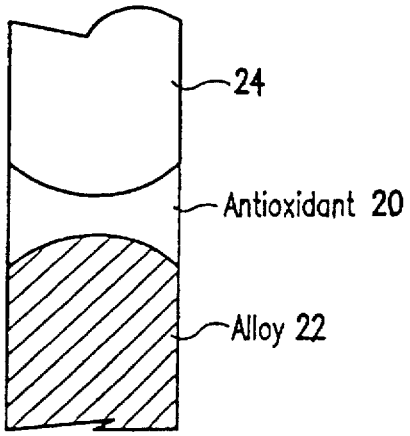
FIG. 2 is an enlarged side view of a dispensing line showing that the gallium or gallium alloy is protected during dispensing by an anti-oxidant and an inert atmosphere.

After oxides have been removed from the metals in the gallium alloy, further oxidation of the metals should be avoided. FIG. 2 shows that an oxidation inhibiting medium 20, which can simply be excess NaOH or the like, can be positioned on top of the gallium alloy 22 at the interface with air to prevent oxidation of the gallium alloy 22 prior to its being dispensed from dispenser tube 24. Other production techniques can be used to separate the gallium alloy from ambient air while it is being dispensed.

FIG. 1 also shows that the capsule 18 and conduit 30 (or conduits-not shown) connected with the dispensing station 16 are connected with a purge station 26 and a vacuum and fill station 28. It is important to understand that oxidation of gallium and gallium alloys occurs very rapidly. Therefore, using an apparatus which prevents oxide formation during dispensing is particularly advantageous. The vacuum will draw ambient air out of the capsule 18 prior to its being filled with gallium alloy. In this way, gallium will not react with ambient air inside the capsule when it is dispensed. The purge station 26 preferably clears the conduit 30 and capsule 18 with an inert gas such as nitrogen or evacuates the conduit and capsule. In this manner, any gallium alloy in the conduit 30 will be protected from oxidation. After gallium alloy is installed in the capsule 18, an inert gas such as hydrogen or argon is added to the capsule 18 such that no air remains in the capsule 18 upon closure by welding 32 or other closing technique. Hydrogen is a less expensive gas to fill the capsule 18; however, argon may be preferred since it is superior to hydrogen at extinguishing arcs. Helium may also be useful.

A prototype dispensing system has been constructed and has been used to reproducibly build devices which use the mercury substitute of the present invention. The dispensing station has a reservoir to hold approximately 400-ml of low melting alloy. The alloy is stored beneath a layer of aqueous base. Below the reservoir are two spaced apart tapered ground glass stopcocks with a graduated tube therebetween. The graduated tube is connected to a vacuum source and is evacuated prior to delivery of the alloy from the reservoir. A housing that is to be filled with the gallium alloy is affixed to the delivery tube of the apparatus and it too is evacuated. The lower stopcock allows a measured amount of alloy (e.g., some or all of the alloy in the graduated tube) to be dispensed through the delivery tube into the housing. The housing is backfilled with hydrogen gas and is subsequently sealed. Finally, while the device is being removed a nitrogen purge is initiated. The nitrogen purge fills the delivery tube with a nonoxidizing, dry atmosphere. In this way, the interior surface of the delivery tube is kept clean and dry. Further, if any alloy remains in the delivery tube it does not oxidize. This equipment is a simple prototype version of an apparatus that can be built to construct large quantities of a variety of devices using mercury substitutes. It also lends itself to automation.

The mercury substitute may be used in temperature sensors and thermometers, pressure sensors or pressure activated switches, pumps and filters, liquid mirror telescopes, fluid unions, slip rings, medical devices such as bougies and sphygmomanometers, and used as a dental amalgam, and in a wide variety of other applications. A bougie is a flexible cylindrical instrument used for calibrating or dilating constructed areas in tubular organs. A sphygmomanometer is used to measure blood pressure. In non-electrical applications which utilize a housing (e.g., bougie, sphygmomanometer, etc.) the gallium alloys of the present invention should be handled in a manner as described above which prevents oxidation of the alloy. Specifically, the alloy should be treated with an oxidation inhibiting medium, and preferably should be installed in the housing under conditions which avoid contact of the alloy with air (e.g. under nitrogen, etc.). In other applications such as liquid mirrors and dental amalgams, the mercury substitute is not exposed to air until after it has been dispensed.

While the invention has been described in terms of its preferred embodiments, those skilled in the art will recognize that the invention can be practiced with modification within the spirit and scope of the appended claims.

We claim:

1. A method for producing a mercury substitute which utilizes gallium, comprising the steps of:

removing metal oxides from gallium or a gallium alloy by a process selected from the group consisting of treating said gallium or gallium alloy with an acid, treating said gallium or gallium alloy with a base, and exposing said gallium or gallium alloy to a reducing agent;

dispensing said gallium or gallium alloy into a housing; and preventing the formation of metal oxides in said gallium or gallium alloy during and after said step of dispensing.

2. The method recited in claim 1 wherein said step of removing oxides is accomplished by treating said gallium or gallium alloy with an acid.

3. The method recited in claim 1 wherein said step of removing oxides is accomplished by treating said gallium or gallium alloy with a base.

4. The method recited in claim 1 wherein said step of removing oxides is accomplished by exposing said gallium or gallium alloy to a reducing agent.

5. The method recited in claim 1 wherein said means for preventing includes the step of positioning an antioxidant on top of said gallium or gallium alloy during dispensing.

6. The method recited in claim 5 wherein said step of positioning includes adding excess NaOH to said gallium or gallium alloy.

7. The method recited in claim 1 wherein said mercury substitute is for a pressure sensor.

8. The method recited in claim 1 wherein said mercury substitute is for a pressure activated switch.

9. The method recited in claim 1 wherein said mercury substitute is for a pump.

10. The method recited in claim 1 wherein said mercury substitute is for a filter.

11. The method recited in claim 1 wherein said mercury substitute is for a liquid mirror telescope.

12. The method recited in claim 1 wherein said mercury substitute is for a fluid union.

13. The method recited in claim 1 wherein said mercury substitute is for a slip ring.

14. The method recited in claim 1 wherein said mercury substitute is for dental amalgam.

15. The method recited in claim 1 wherein said mercury substitute is for a sphygmomanometer.

16. The method recited in claim 1 wherein said mercury substitute is for a bougie.

* * * * *